US008561544B2

(12) United States Patent
Baumann et al.

(10) Patent No.: US 8,561,544 B2
(45) Date of Patent: Oct. 22, 2013

(54) METHOD FOR PRODUTION OF A PROJECTILE, AS WELL AS A PROJECTILE

(75) Inventors: Christian Baumann, Martinsreth (DE); Holger Brase, Bergen (DE); Thomas Heitmann, Unterlüss (DE); Michael Vagedes, Hermannsburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 136 days.

(21) Appl. No.: 12/733,186

(22) PCT Filed: Jul. 25, 2008

(86) PCT No.: PCT/EP2008/006110

§ 371 (c)(1), (2), (4) Date: Feb. 16, 2010

(87) PCT Pub. No.: WO2009/021607

PCT Pub. Date: Feb. 19, 2009

(65) Prior Publication Data

US 2010/0139518 A1 Jun. 10, 2010

(30) Foreign Application Priority Data

Aug. 14, 2007 (DE) ..... 10 2007 038 486

(51) Int. Cl.
*F42B 14/06* (2006.01)

(52) U.S. Cl.
USPC ..... 102/523; 86/52

(58) Field of Classification Search
USPC ..... 102/520, 521, 522, 523; 86/52
See application file for complete search history.

(56) References Cited

U.S. PATENT DOCUMENTS 3,745,926 A 7/1973 Mertz et al.
4,296,687 A 10/1981 Garrett
4,360,954 A * 11/1982 Burns et al. ..... 86/52
4,459,894 A * 7/1984 Bunch ..... 86/1.1

(Continued)

FOREIGN PATENT DOCUMENTS

DE 36 35 738 A1 5/1988
DE 4330417 A1 3/1995

(Continued)

OTHER PUBLICATIONS

International Search Report, issued in corresponding application No. PCT/EP2008/006110, completed Dec. 22, 2008, mailed Jan. 1, 2009.

(Continued)

*Primary Examiner* — James Bergin
(74) *Attorney, Agent, or Firm* — Griffin & Szipl, P.C.

(57) ABSTRACT

The invention relates to a projectile (1) having a sub-caliber projectile core (2) and a guide cage or sabot (3) that comprises a driving element (4), which acts on the projectile core (2) at the rear thereof and is in the form of a plate composed of metal. In order to produce such a projectile (1) at low cost, the projectile core (2) and the driving element (4), which is in the form of a plate, are inserted as inserts into an injection-molding tool, and are extrusion-coated so that the injection-mold shape is chosen so that the contour of the guide cage or sabot (3) of the projectile (1) is produced after the injection-molding process.

35 Claims, 4 Drawing Sheets

(56) References Cited

U.S. PATENT DOCUMENTS

| | | | | | |
|---|---|---|---|---|---|
| 4,505,204 | A | | 3/1985 | Wikstrom | |
| 4,709,638 | A | | 12/1987 | Broden et al. | |
| 4,850,280 | A | * | 7/1989 | Wallow et al. | 102/522 |
| 4,854,242 | A | | 8/1989 | Katzmann | |
| 4,982,669 | A | | 1/1991 | Bisping et al. | |
| 5,052,305 | A | | 10/1991 | Chiarelli et al. | |
| 5,404,816 | A | * | 4/1995 | Burri | 102/523 |
| 5,477,786 | A | * | 12/1995 | Leeker et al. | 102/522 |
| 5,481,981 | A | | 1/1996 | Sippel et al. | |
| 5,635,660 | A | * | 6/1997 | McGovern | 86/21 |
| 5,640,054 | A | * | 6/1997 | McGovern | 264/3.1 |
| 7,934,456 | B1 | | 5/2011 | Heitmann et al. | |
| 2010/0000439 | A1 | | 1/2010 | Baumann et al. | |

FOREIGN PATENT DOCUMENTS

| | | | |
|---|---|---|---|
| EP | 0 645 600 | A | 3/1995 |
| FR | 2 642 161 | A | 7/1990 |
| GB | 2 121 146 | A | 12/1983 |

OTHER PUBLICATIONS

Office Action issued in co-pending related U.S. Appl. No. 12/673,485 on Dec. 23, 2011.

* cited by examiner

METHOD FOR PRODUTION OF A PROJECTILE, AS WELL AS A PROJECTILE

This is a National Phase Application in the United States of International Patent Application No. PCT/EP2008/006110 filed Jul. 25, 2008, which claims priority on German Patent Application No. 10 2007 038 486.8, filed Aug. 14, 2007. The entire disclosures of the above patent applications are hereby incorporated by reference.

FIELD OF THE INVENTION

The present invention relates to a method for production of a projectile, and to the projectile produced in this way, having a subcaliber projectile core and a guide sabot that has a drive element, wherein the drive element is in the form of a plate and acts on the projectile core at the rear end thereof, and to an essentially cylindrical guide sabot that is adjacent to the drive element and is composed of plastic.

BACKGROUND OF THE INVENTION

DE 36 35 738 A1 discloses a discarding sabot projectile, in which the front-end support and centering of the projectile core are carried out by a relatively narrow annular holder, which is connected via short ribs to the outer wall of the discarding sabot. A second centering holder is located in the unobstructed internal cross section/caliber of the projectile.

A discarding sabot for a subcaliber projectile has been published in DE 43 30 417 C2. In this case, the discarding sabot is a segmented, essentially hollow-cylindrical, guide sabot composed of a lightweight material that is less strong than steel. A conical drive element is inserted, detachably, in an inner circumferential groove at the lower end of the guide sabot, in the projectile direction. The subcaliber projectile is additionally surrounded at its lower end by the guide sabot, and is centered at its front-to-central area by a supporting wall on which there is, or are, a hole or holes. The drive element (pusher plate) pushes the projectile through a weapon barrel, while the discarding sabot, or guide sabot, pulls the projectile.

These known discarding sabot projectiles have the disadvantage, inter alia, that their production is relatively complex because the discarding sabot must be assembled from a plurality of components, and the projectile core must be separately connected to the discarding sabot. Furthermore, the rubber elements, as well as insert parts, must be introduced into the discarding sabot shells. In this case, the insertion and attachment of the rubber elements are highly time-consuming, for tolerance compensation.

The invention is based on the object primarily of specifying a method, in particular for a kinetic-energy exercise projectile, which allows cost-effective production without any negative influence on the durability and hit accuracy of the projectile.

BRIEF SUMMARY OF THE INVENTION

With regard to the method, the object of the invention is achieved according to the invention by the features of a first embodiment thereof, and with regard to the projectile it is achieved by the features of fourth embodiment of the invention. Furthermore, particularly advantageous refinements of the invention are disclosed with respect to additional embodiments.

More specifically, in accordance with the first embodiment of the invention, a method is provided for production of a projectile, having a subcaliber projectile core (2) and a sabot (3) as a guide sabot that has a drive element (4), which is in the form of a plate and acts on the projectile core (2) at the rear end, and adjacent to the drive element (4), wherein the essentially cylindrical guide sabot (3) is composed of a plastic or material which is similar to a plastic, and the drive element (4) and the projectile core (2) are detachably connected to one another, and are inserted as insert into an injection-molding tool, which produces the contour of the guide sabot (3), and are insert molded. In accordance with a second embodiment of the invention, the first embodiment is modified so that weak points (8, 14, 16) are also injection molded. In accordance with a third embodiment of the present invention, the first embodiment and the second embodiment are further modified so that guide sabot segments (9) are injection molded at the same time by means of a number of gates corresponding to the segments, such that the material that flows into the mold areas, which form the segments, meets at the weak points (16).

In accordance with the fourth embodiment of the present invention, a projectile is provided having a subcaliber projectile core (2), and a sabot (3) as a guide sabot, which has a drive element (4) that is in the form of a plate and acts on the projectile core (2) at the rear end, and an essentially cylindrical guide sabot (3), which is adjacent to the drive element (4) and is composed of plastic, wherein the drive element (4) is firmly incorporated in the guide sabot (3) at the rear end. In accordance with a fifth embodiment of the present invention, the fourth embodiment is modified so that the guide sabot (3) has an outer wall (6) in which at least two weak points (8) are provided, which are arranged distributed uniformly over the circumference and extend in the axial direction, and a rear wall (12), which is adjacent to the drive element (4), runs radially and is likewise provided with weak points (16), which are adjacent to the weak points (8) in the outer wall (6). In accordance with a sixth embodiment of the present invention, the fourth embodiment and the fifth embodiment are further modified so that the projectile core (2) is connected via at least two spacing elements (10), which are in the form of longitudinal ribs, to the inner surface of the outer wall (6), wherein one longitudinal rib (10) is in each case associated with a guide sabot segment (9) that is defined by adjacent weak points (8) that extend axially from the rear wall (12) into the nose area of the guide sabot (3).

In accordance with a seventh embodiment of the present invention, the fourth embodiment, the fifth embodiment and the sixth embodiment are further modified so that the guide sabot (3) is formed integrally, and at least partially surrounds, the drive element (4) on the outside. In accordance with an eighth embodiment of the present invention, the fourth embodiment, the fifth embodiment, the sixth embodiment, and the seventh embodiment are further modified so that the longitudinal ribs (10) have recesses (17), in the form of pockets, at the front end. In accordance with a ninth embodiment of the present invention, the first embodiment, the second embodiment and the third embodiment are further modified so that the longitudinal ribs (10) each have a conically tapering profile that extends forward from the rear wall (12) of the guide sabot (3).

In accordance with a tenth embodiment of the present invention, the first embodiment, the second embodiment, the third embodiment, the fourth embodiment and the fifth embodiment are further modified so that the guide sabot (3) has a sleeve (11) which surrounds the projectile core (2) and is in the form of a web, to which the longitudinal ribs (10) are connected on the projectile side, and in that the sleeve (11), which is in the form of a web, is also provided with weak points (16) that extend in the axial direction and are adjacent to the weak points (16) in the rear wall (12). In accordance with an eleventh embodiment of the present invention, the sixth embodiment is further modified so that the weak points (16) extend to the surface of the projectile core (2). In accordance with a twelfth embodiment of the invention, the first embodiment, the second embodiment, the third embodiment, the fourth embodiment, the fifth embodiment, the sixth embodiment and the seventh embodiment are further modified so that the guide sabot (3) is composed of a glass-fiber-reinforced or carbon-fiber-reinforced polyamide. In accordance with a thirteenth embodiment of the present invention, the first embodiment, the second embodiment, the third embodiment, the fourth embodiment, the fifth embodiment, the sixth embodiment, the seventh embodiment, and the eighth embodiment are further modified so that the guide sabot (3) has four weak points (8) that are arranged distributed uniformly over the circumference of the outer wall (6) and extend in the axial direction, wherein the weak points (8) are located rotated through 45° with respect to the longitudinal ribs (10).

The present invention is essentially based on the idea of producing a cost-effective projectile by inserting a projectile core together with a drive element as an insert, into an injection-molding tool, and insert-molding it, wherein the injection-molding mold is chosen so that the injection-molding process results in the contour of the guide sabot (inner core and outer shell) of the projectile sabot. The guide sabot is generated directly by an injection-molding process, and is connected to the insert parts (drive element, projectile) which are composed of metal, aluminum, etc. There is no need for subsequent assembly and setting to a specific external dimension (i.e., caliber dimension), thus reducing the manufacturing and assembly time, and thus producing a more cost-effective projectile.

The material to be injection molded may be a plastic, a fiber-reinforced plastic, or a material that is similar to a plastic.

A projectile that can be produced in this way has a guide sabot with an outer wall, which, in a development of the invention, may have at least two, but preferably three, weak points that are arranged and distributed uniformly over the circumference and extend in the axial direction. The projectile also has a radially running rear wall, which is adjacent to the drive element and can likewise be provided with weak points that are adjacent to the weak points in the outer wall. When they are provided, the weak points are also injection molded according to the invention, creating a discarding sabot formed from a plurality of parts, which can break up more easily. The projectile core is supported via at least three spacing elements, which are in the form of longitudinal ribs, on the inside of the outer wall, wherein in each case one longitudinal rib is associated with one guide sabot segment, which is defined by adjacent weak points, and wherein the longitudinal ribs extend axially from the drive element into the nose area of the guide sabot.

Furthermore, it has been found to be advantageous for the integrally formed guide sabot to also, at least partially, surround the drive element at the rear end. In order to assist an advantageous separation behavior for the guide sabot segments, the longitudinal ribs may have recesses in the form of pockets at the front end. In addition, a conically tapering profile of the longitudinal ribs extending forward from the rear wall makes it easier to remove the guide sabot from the injection-molding tools during the mold-removal process.

In a further embodiment of the invention, the guide sabot contains a sleeve that holds the projectile body and is in the form of a web, by means of which the longitudinal ribs are connected at the projectile end, wherein the sleeve, which is in the form of a web, is also provided with weak points that extend in the axial direction. In this case, the weak points may extend radially through the sleeve wall as far as the projectile body.

The use of a plastic as a projectile sabot can be assisted by the design of the drive element. This drive element is then designed so that it pushes the projectile through a weapon barrel, while the projectile sabot now acts only as a guide sabot for guiding the projectile, without any force being transmitted by the sabot and projectile.

BRIEF DESCRIPTION OF THE DRAWINGS

Further details and advantages of the invention will become evident from the following exemplary embodiments, which are explained with reference to the following figures, in which.

DETAILED DESCRIPTION OF THE INVENTION

Figure 1:
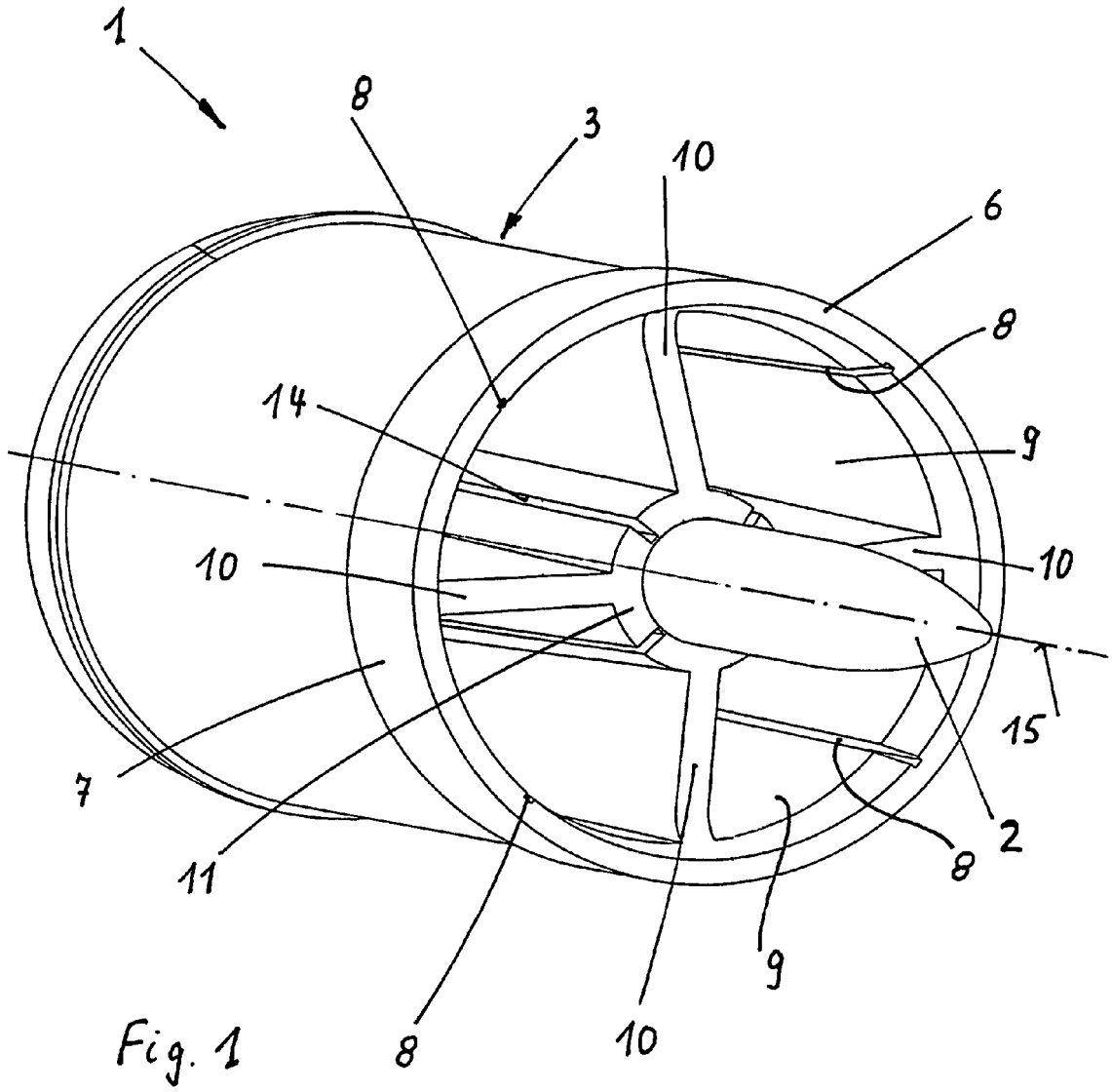
FIG. 1 shows a perspective view of a discarding sabot projectile according to the invention.
Figure 2:
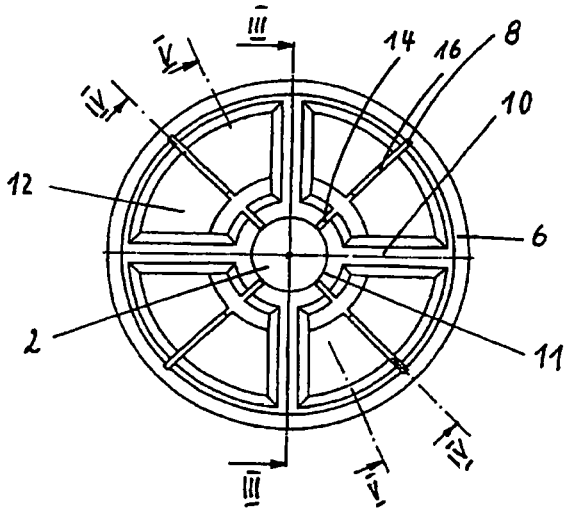
FIG. 2 shows a front view of the discarding sabot projectile illustrated in FIG. 1.

In FIGS. 1 and 2 to 5, 1 denotes a projectile according to the invention that can be fired from a 120 mm tank gun. The illustrated projectile 1 is, in this case, an exercise projectile.

The projectile 1 comprises a projectile core 2, for example composed of steel, and a guide sabot 3. In its rear area, the guide sabot 3 surrounds a drive element 4 that is in the form of a plate and is composed, for example of aluminum, and is composed of a glass-fiber-reinforced or carbon-fiber-reinforced plastic (for example polyamide).

The guide sabot 3 has an outer wall 6, which, at the front end, has a guide area 7 that rests against the corresponding inner barrel wall when the discarding sabot projectile 1 passes through a weapon barrel (not illustrated). On the inside, at least two and preferably four weak points 8 are provided in the outer wall 6, wherein the weak points 8 are arranged and distributed uniformly over the inner circumference of outer wall 6 and extend in the axial direction of the outer wall 6 so that adjacent weak points in this exemplary embodiment define four guide sabot segments 9 (in practice, an odd number of grid points and weak points is preferable).

The corresponding guide sabot segment 9 is, in each case, supported between two adjacent weak points 8 (that is to say in the case of the exemplary embodiment illustrated in FIGS. 1-5 rotated, for example, through 45° with respect to the weak points, although this is not restrictive or limiting and other angles are also possible) via a spacing element 10, which is in the form of a longitudinal rib, arranged on a sleeve 11 that surrounds the projectile core 2 and is in the form of a web. In this case, the longitudinal ribs 10 extend from a rear wall 12, which is adjacent to the drive element 4, into the nose area of the guide sabot 3 and the longitudinal ribs 10 have recesses 13 in the form of pockets at the front end of the ribs 10, in order to assist the separation behavior of the guide sabot segments 9 when the sabot projectile 1 is fired.

The sleeve 11, which surrounds the projectile core 2 and is in the form of a web, of the guide sabot 3 likewise has weak points 14 that extend in the axial direction and extend through the sleeve wall to the surface of the projectile core 2, and the weak points 14 are in the same angular position, relative to the center of the projectile core 2, as the weak points 8 in the outer wall 6 with respect to the longitudinal axis 15 of the sabot projectile 1. See, e.g., FIG. 1. As can be seen in particular from FIGS. 2 and 4, the rear wall 12 of the guide sabot 3 has radial weak points 16, which are adjacent to the weak points 8 in the outer wall 6 and to the weak points 14 in the sleeve 11, which is in the form of a web. Thus, the weak points 14, 16 and 8 are arranged radially along a radius from the longitudinal axis 15 of the sabot projectile 1 as shown in FIG. 1.

In order to produce the projectile 1, according to the invention, the guide sabot 3, the projectile core 2, and the drive element 4 are, first of all, detachably connected to one another, for example by clamping, and then they are inserted into an injection molding tool, which produces the contour of the guide sabot 3. The injection molding tool is then closed, and the injection molding process is started. In this case, the four (in accordance with this exemplary, non-limiting embodiment) guide sabot segments 9 of the guide sabot 3 are injection molded with the aid of four gates.

The material that flows into the mold areas that form the segments is intended to meet at the weak points, which are provided. This results in the creation of so-called "weld lines," which further additionally weaken the material at the weak point. It is therefore important to fill the four mold areas in parallel. Furthermore, the effect of the weak points is also assisted if the fibers are aligned parallel to the injection direction during the injection process.

After being removed from the mold, the provisional clamping between the projectile and the drive element is removed, and a tracer charge (not illustrated) is screwed into the appropriate recess 17 in the rear-end part of the projectile core 2.

In order to ensure removal from the mold as easily as possible, the longitudinal ribs 10 should taper conically (for example, with a cone angle of 1°) in the direction in which they are removed from the mold (which corresponds to the firing direction of the projectile).

Figure 3:
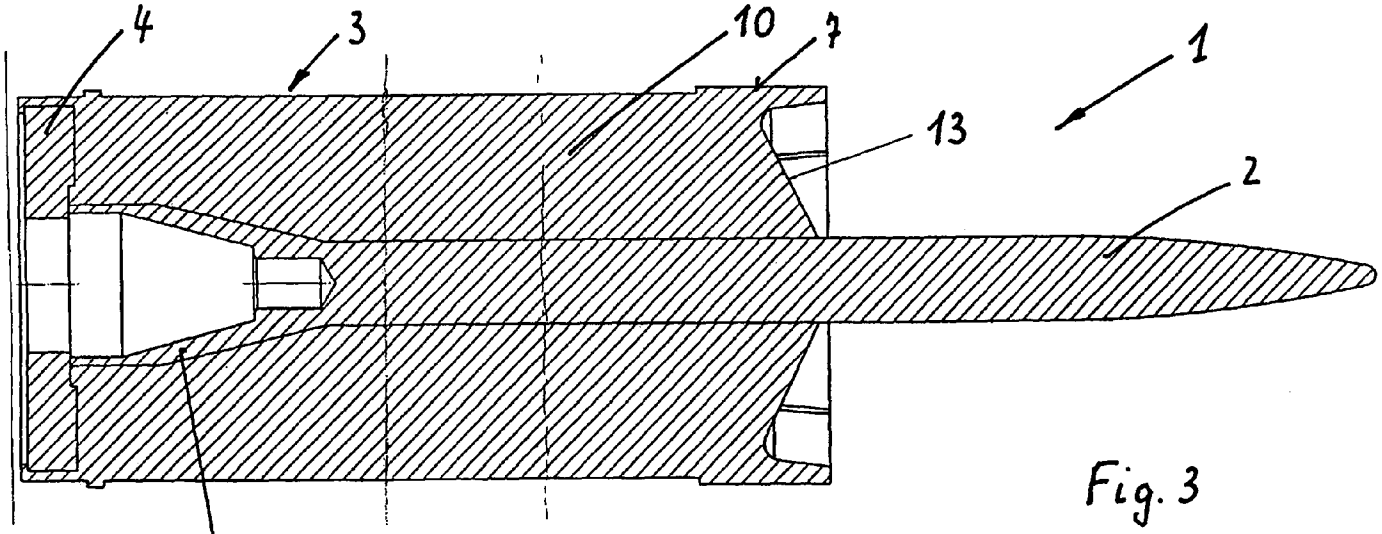
FIGS. 3 to 5 show three longitudinal sections through the discarding sabot projectile illustrated in FIG. 1, along the section lines annotated III-III, IV-IV and V-V respectively in FIG. 2.
Figure 4:
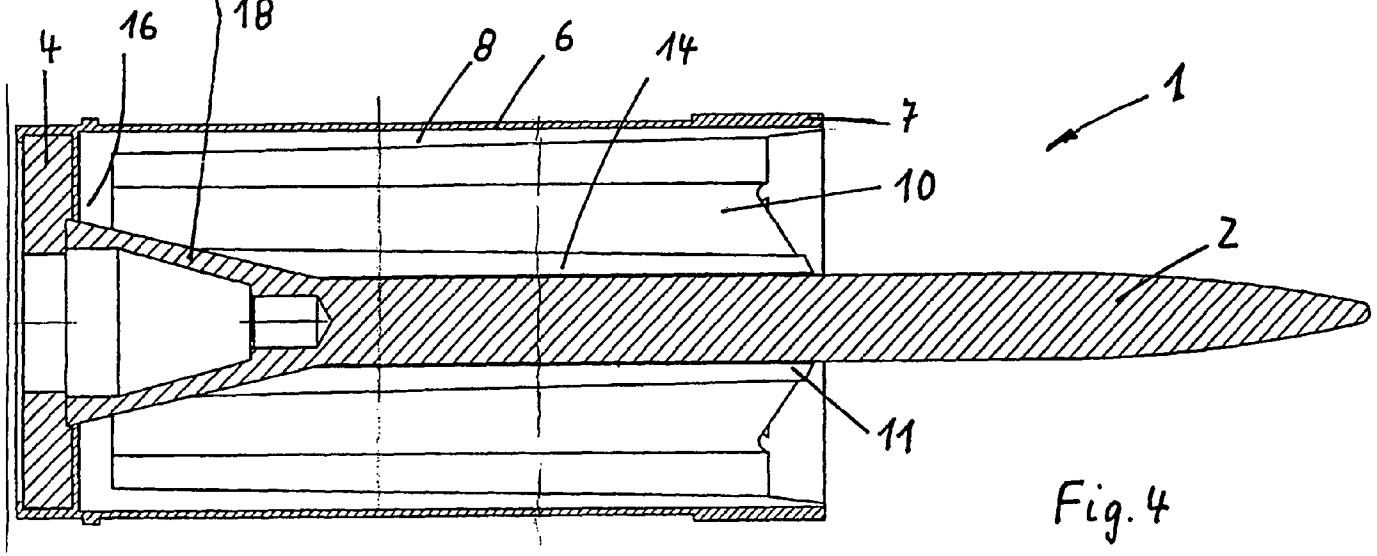
Figure 5:
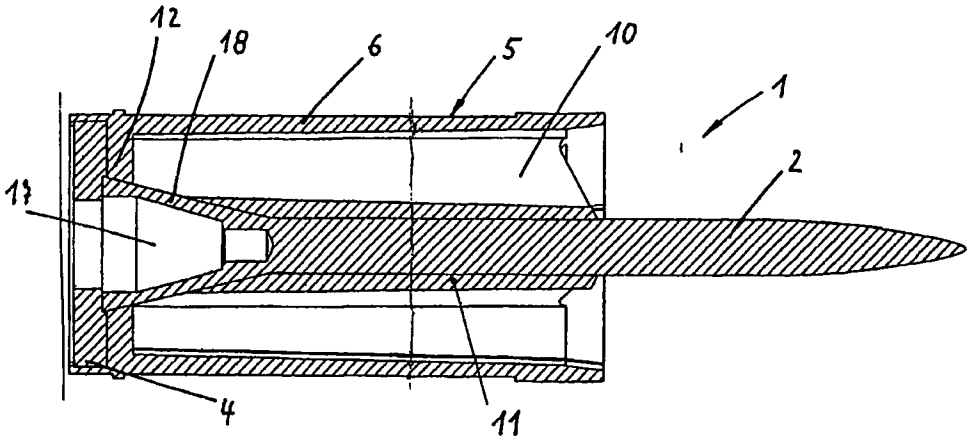

If the projectile cores 2, as illustrated in FIGS. 3-5 and provided with a conical fin assembly 18, are provided with mold-out areas on the external circumference of the conical fin assembly in order to produce a compensating spin (not illustrated), the longitudinal ribs 10 must engage in these recesses (injection-molded). In this case, care should be taken to ensure that the number of mold-out areas arranged in the fin assembly corresponds to the number of longitudinal ribs and, therefore, guide sabot segments present. Otherwise, problems can occur during the separation process of the guide sabot segments because of undercuts when the discarding sabot projectile is fired.

The present invention, is, of course, not restricted to the exemplary embodiment described above. For example, it is possible to dispense with the inner wall of the guide sabot 3 surrounding the projectile core 2. In this case, the longitudinal ribs are directly supported on the surface of the projectile core. In addition, the injection-molding apparatus then has a different form.

The projectile according to the present invention may also be a live projectile in which the projectile core is, for example, replaced by a penetrator composed of a heavy metal.

Furthermore it is, in this way, also possible to produce projectiles with a sabot, whose sabots are separated by ram-air pressure or centrifugal force, etc.

LIST OF REFERENCE SYMBOLS

1 Projectile
2 Projectile core
3 Guide sabot
4 Drive element
6 Outer wall
7 Guide area
8 Weak point (outer wall)
9 Guide sabot segment
10 Spacing element, longitudinal rib
11 Sleeve
12 Rear wall
13 Recess
14 Weak point (sleeve)
15 Longitudinal axis
16 Weak point (rear wall)
17 Recess
18 Conical fin assembly

The invention claimed is:

1. A projectile comprising:

(a) a subcaliber projectile core; and (b) a sabot provided as a guide sabot that has a drive element, wherein the drive element is in the form of a plate and is disposed to act on the projectile core at a rear end of the projectile core, and the guide sabot is an essentially cylindrical guide sabot disposed adjacent to the drive element, and the guide sabot comprises plastic that is a fiber-reinforced plastic, and the drive element is firmly incorporated in the guide sabot at a rear end of the projectile so that the guide sabot is formed integrally with the drive element, wherein the guide sabot has an outer wall in which at least two first weak points are provided, wherein the at least two first weak points are arranged and distributed uniformly over a circumference of the outer wall and extend in an axial direction, and the guide sabot has a rear wall that is adjacent to the drive element, and the rear wall extends radially with respect to a longitudinal axis of the projectile and the rear wall is likewise provided with second weak points, wherein the second weak points of the rear wall are adjacent to the first weak points in the outer wall.

2. The projectile as claimed in claim 1, wherein the projectile core is connected to an inner surface of the outer wall of the guide sabot via at least two spacing elements that are in the form of longitudinal ribs, wherein each longitudinal rib is associated with a guide sabot segment, wherein each guide sabot segment is defined by adjacent first weak points formed in the outer wall and that extend axially from the rear wall of the guide sabot into a nose area of the guide sabot.

3. The projectile as claimed in claim 2, wherein the longitudinal ribs have recesses, in the form of pockets, located at a front end of the longitudinal ribs.

4. The projectile as claimed in claim 2, wherein the longitudinal ribs each have a conically tapering profile that extends forward from the rear wall of the guide sabot.

5. The projectile as claimed in claim 2, wherein the first weak points formed in the outer wall of the guide sabot extend to a surface of the projectile core.

6. The projectile as claimed in claim 2, wherein the guide sabot has four first weak points formed in the outer wall of the guide sabot, wherein the four first weak points are arranged and distributed uniformly over an inner circumference of the outer wall and extend in the axial direction, wherein the four first weak points formed in the outer wall of the guide sabot are located so as to be rotated through 45° with respect to the longitudinal ribs.

7. The projectile as claimed in claim 1, wherein the guide sabot at least partially surrounds the drive element on an outside surface of the drive element.

8. The projectile as claimed in claim 7, wherein the projectile core is connected to an inner surface of the outer wall of the guide sabot via at least two spacing elements that are in the form of longitudinal ribs, wherein each longitudinal rib is associated with a guide sabot segment, wherein each guide sabot segment is defined by adjacent first weak points formed in the outer wall and that extend axially from the rear wall of the guide sabot into a nose area of the guide sabot.

9. The projectile as claimed in claim 1, wherein the guide sabot has a sleeve that surrounds the projectile core and is in the form of a web, wherein longitudinal ribs are connected on a projectile side to the web, and the sleeve is also provided with third weak points that extend in an axial direction with respect to a longitudinal axis of the projectile core, and the third weak points of the sleeve are adjacent to second weak points disposed in a rear wall of the guide sabot.

10. The projectile as claimed in claim 1, wherein the fiber-reinforced plastic is a glass-fiber-reinforced polyamide plastic or a carbon-fiber-reinforced polyamide plastic.

11. The projectile as claimed in claim 1, wherein the guide sabot includes the first weak points, the second weak points and third weak points formed therein, wherein the first weak points are formed in an outer wall of the guide sabot, and the second weak points are formed in a wall of a sleeve of the guide sabot that surrounds the projectile core, and the third weak points are formed in a rear wall of the guide sabot, wherein at least one first weak point, and at least one second weak point, and at least one third weak point are formed so as to be radially aligned along a single radial line extending from a longitudinal axis of the projectile core, and wherein weld lines are formed in material of the guide sabot at the second weak points formed in the rear wall of the guide sabot, and the weld lines weaken the material at the second weak points formed in the rear wall of the guide sabot.

12. A projectile comprising:

(a) a sub-caliber projectile core;

(b) a sabot serving as guide sabot; and (c) a plate-shaped drive element acting on a rear side of the projectile core, wherein, adjacent to the drive element, the guide sabot is disposed as an essentially cylindrical guide sabot made of plastic material, wherein the drive element is in the rear of the projectile firmly integrated in the guide sabot, and the guide sabot has an outer wall in which is provided at least two first predetermined weak points that are arranged uniformly distributed over a circumference of the outer wall, extending in an axial direction, and a radially extending rear wall adjacent to the drive element that is likewise equipped with predetermined second weak points that meet with the predetermined first weak points of the outer wall of the guide sabot.

13. A projectile according to claim 12, wherein the projectile core is connected with an interior surface of the outer wall via at least two spacing elements comprising longitudinal ribs, wherein one longitudinal rib is associated with each guide sabot segment defined by adjacent predetermined first weak points that extend axially from the rear wall up to a forward side of the guide sabot.

14. A projectile according to claim 13, wherein the longitudinal ribs have pocket-like recesses disposed in a front portion.

15. A projectile according to claim 13, wherein the longitudinal ribs respectively present a conically tapering course towards a front of the projectile.

16. A projectile according to claim 13, wherein the guide sabot has a bridge-configured sleeve enveloping the projectile core, wherein the sleeve connects the longitudinal ribs on a projectile side, and the sleeve is provided with predetermined third weak points extending in axial direction that meet with the predetermined second weak points of the rear wall.

17. A projectile according to claim 13, wherein the guide sabot includes four predetermined first weak points that are uniformly distributed over the circumference of the outer wall, extending in the axial direction, wherein the predetermined weak points are located at a 45° angle relative to the longitudinal ribs.

18. A projectile according to claim 12, wherein the guide sabot is constructed in one piece and encloses, at least partially, the driving element on an outside.

19. A projectile according to claim 12, wherein the predetermined second weak points extend up to the surface of the projectile core.

20. A projectile according to claim 12, wherein the guide sabot comprises glass-fiber-reinforced polyamide or carbon-fiber-reinforced polyamide.

21. A projectile according to claim 12, wherein the projectile core is provided with a conical fin assembly.

22. A method for production of a projectile, according to claim 1, comprising the steps of:

(a) provisionally detachably connecting a drive element and a projectile core to one another to form an insert;

(b) inserting the insert into an injection-molding tool, and using the injection-molding tool to produce a contour of a guide sabot;

(c) injection molding the insert in the injection-molding tool with a material so as to produce the projectile, wherein the guide sabot of the projectile is an essentially cylindrical guide sabot comprising a plastic, wherein the plastic is a fiber-reinforced plastic;

(d) removing the projectile from the injection-molding tool; and (e) after the projectile is removed from the injection-molding tool, then removing the provisional connection formed in step (a) between the drive element and the projectile core.

23. The method as claimed in claim 22, wherein weak points are also injection molded in the projectile during step (c).

24. The method as claimed in claim 23, wherein the weak points injection molded in the projectile during step (c) include first weak points, second weak points and third weak points, wherein the first weak points are formed in an outer wall of the guide sabot, and the second weak points are formed in a wall of a sleeve that surrounds the projectile core, and the third weak points are formed a rear wall of the guide sabot.

25. The method as claimed in claim 24, wherein at least one first weak point, and at least one second weak point, and at least one third weak point are formed by injection molding so as to be radially aligned along a single radial line extending from a longitudinal axis of the projectile core.

26. The method as claimed in claim 23, wherein guide sabot segments are injection molded in the projectile at the same time by using a number of gates corresponding to the number of guide sabot segments so the material that flows into mold areas and form the guide sabot segments meet at those weak points formed in a rear wall of the guide sabot.

27. The method as claimed in claim 22, wherein guide sabot segments are injection molded in the projectile at the same time by using a number of gates corresponding to the number of guide sabot segments so the material that flows into mold areas and form the guide sabot segments meet at weak points formed in a rear wall of the guide sabot.

28. The method as claimed in claim 27, wherein weld lines are formed when the material meets at the weak points formed in the rear wall of the guide sabot, and the weld lines weaken the material at the weak points formed in the rear wall of the guide sabot.

29. The method as claimed in claim 28, wherein the material includes fibers, and the fibers are aligned parallel to an injection direction during injection molding.

30. A method for production of a projectile having a subcaliber projectile core and a sabot provided as a guide sabot, according to claim 12, comprising the steps of:

(a) provisionally detachably connecting a drive element and the projectile core with each other;

(b) inserting and over-molding the drive element and the projectile core as an inlay unit in an injection molding tool;

(c) producing a contour of the guide sabot; and (d) after de-molding the inlay unit, removing the provisional connection formed in step (a) between the projectile core and the drive element.

31. A method according to claim 30, wherein predetermined weak points are also injection molded.

32. A method according to claim 31, wherein guide sabot elements are simultaneously injection-molded by a segment-corresponding number of gates so that material flowing into segment-forming molding areas meets at the predetermined weak points.

33. A method according to claim 30, wherein guide segments of the guide sabot are injection molded with the aid of gates.

34. A method according to claim 30, wherein a tracer set is screwed into an appropriate recess of a rear sided part of the projectile core.

35. A method according to claim 30, wherein the provisional connection is attained by clamping.

* * * * *